United States Patent [19]

Ingram

[11] Patent Number: 4,816,109

[45] Date of Patent: Mar. 28, 1989

[54] TAPE DISPENSER FOR TAPING A PRODUCT

[75] Inventor: Lawrence L. Ingram, Salinas, Calif.

[73] Assignee: Tanimura & Antle Partnership, Salinas, Calif.

[21] Appl. No.: 187,475

[22] Filed: Apr. 28, 1988

Related U.S. Application Data

[63] Continuation-in-part of Ser. No. 894,211, Aug. 7, 1986, Pat. No. 4,759,819.

[51] Int. Cl.[4] ..... B26F 3/02

[52] U.S. Cl. ..... 156/443; 53/587; 53/592; 156/459; 156/522; 225/72

[58] Field of Search ..... 156/185, 186, 187, 212, 156/215, 443, 459, 468, 475, 483, 522, 530, 510; 225/72, 73, 74; 53/587, 592

[56] References Cited

U.S. PATENT DOCUMENTS 3,389,039 6/1968 Steckler ..... 156/468

FOREIGN PATENT DOCUMENTS 617986 4/1961 Canada ..... 225/72

*Primary Examiner*—Michael Wityshyn

*Attorney, Agent, or Firm*—Charles E. Wills

[57] ABSTRACT

A tape dispenser for taping a product. A lever unit is pivotally mounted in a frame, with a support for a roll of tape. A cutter head and a tape roller are carried by the lever unit, with the tape following a path from the initial roll of tape over the roller to the cutter head, with the adhesive side of the tape exposed and away from the components of the dispenser. The cutter head is pivotally mounted on the lever unit and a linkage or a rack and pinion provides for pivoting the cutter head from a tab folding position to a cutting position as tape is pulled from the roll, over the roller and onto the product. The taped product is cut from the remainder of the tape at the cutter thereby releasing the pulling force on the lever unit which returns to its original position producing slack in the tape which is folded over to produce the desired tab.

18 Claims, 5 Drawing Sheets

FIG. 9.
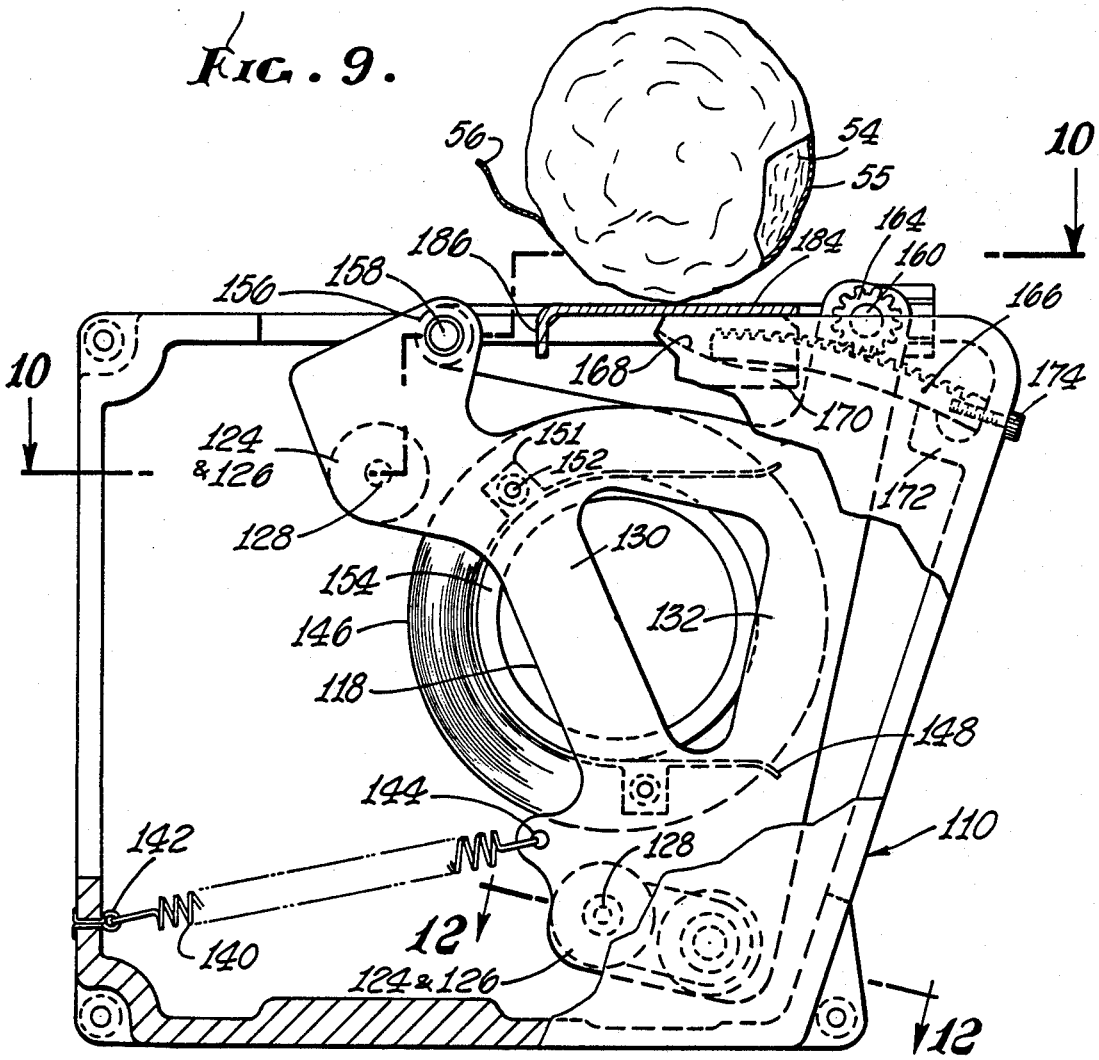
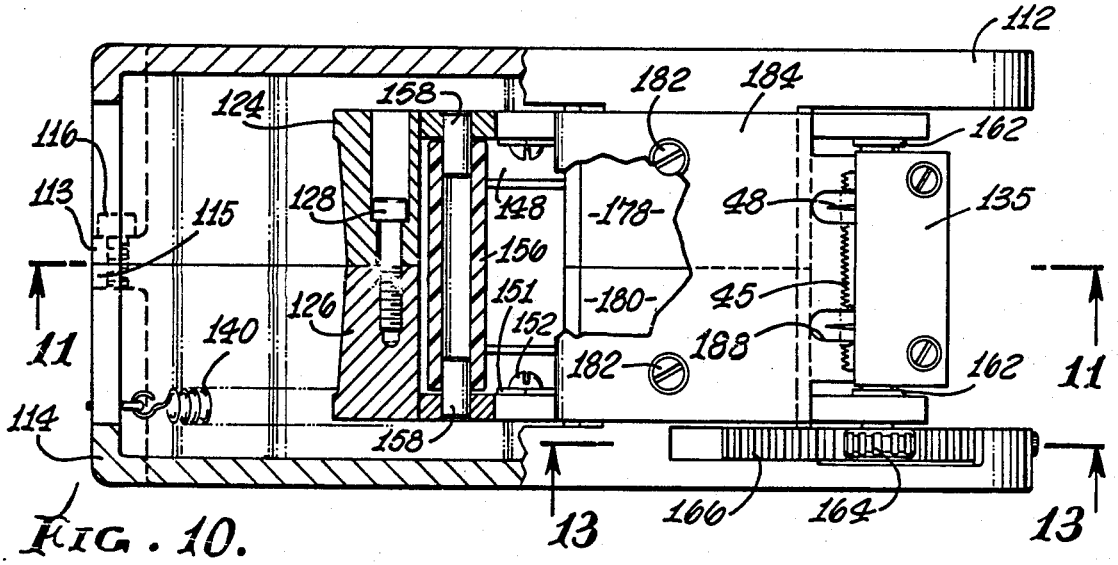
FIG. 10.

TAPE DISPENSER FOR TAPING A PRODUCT

CROSS REFERENCE TO RELATED APPLICATION

This application is a continuation-in-part of application Ser. No. 06/894,211, filed Aug. 7, 1986, now U.S. Pat. No. 4,759,819.

BACKGROUND OF THE INVENTION

This invention relates to tape dispensing and in particular, to a new and improved apparatus for quick and easy taping of a product in a single motion by the operator.

Adhesive tapes are utilized for a variety of purposes including packaging of products, and the present invention will be described in conjunction with the packaging of farm produce, typically heads of lettuce. However, it will be understood that the apparatus is equally applicable to the taping of other products and the invention is not intended to be limited to this specific use.

As an example, in a typical harvesting activity, individual heads of lettuce are packed in individual plastic bags, with each bag being twisted to close the opening. Next a piece of adhesive tape, typically a clear plastic tape with adhesive on one side, is wrapped around the bag over the twisted closure to seal the bag. Later at the retail market, if the head of lettuce is required to be trimmed by the green grocer, it is necessary to tear open the bag, trim the head, place it in a new bag, and reseal it. Obviously, this procedure requries additional bags and is very time-consuming.

A variety of tape dispensers have been used in the past for various sealing and packaging purposes. The most common dispenser includes a holder for a roll of tape and a serrated edge affixed to the holder. The tape is pulled from the roll over the serrated edge and the tape is cut or severed by a sideways pulling motion across the serrated edge. The free end of the roll of tape is maintained in position at the cutter by having the adhesive side of the tape facing downward so that it engages the support for the cutter. However, in order to dispense another length of tape from the roll, the free end must be raised from the cutter support and then pulled from the roll as previously described.

A variation of the tape dispenser described in the preceding paragraph has a separate tab forming unit pivoted at the cutting edge, with the tab being formed by the operator pushing on the tab forming device before the desried length of tape is pulled from the roll and severed at the cutter.

Another type of tape dispenser has a support for the roll of tape and a working platform adjacent to the tape roll, with the cutting edge positioned at the end of the platform remote from the roll of tape. In this device, the tape lies across the working platform with the adhesive side facing up away from the platform. This unit is utilized by placing the product down onto the adhesive side of the tape, rolling the product and pulling tape from the roll, and then separating the tape by pulling it across the cutting edge. One problem with this configuration is that there is nothing which holds the tape in place on the platform and therefore the tape is readily displaced by a breeze or other ambient disturbance. While this device does permit use without requiring preliminary lifting of the free end of the tape from a support, the device does not form any type of tab.

Accordingly, it is an object of the present invention to provide a new and improved apparatus for taping a product which can be operated with one motion and which forms a tab for facilitating subsequent handling of the tape.

It is another object of the invention to provide such an apparatus wherein the adhesive side of the tape faces upward away from the tape dispenser permitting wrapping of a product by laying the product onto the adhesive side of the tape, rolling the product and pulling tape from the supply, and cutting off the tape with the conventional downward motion, with the desired tab being formed automatically and with the dispenser holding the tape in position for the next wrap by gripping the tab.

A further object is to provide such an apparatus in which the cutting edge is shielded when in the rest or inoperative position, so as to avoid damage to the blade and increase the safety to workers. An additional object is to provide such an apparatus which utilizes one moving member as the lever mechanism, with a pinon gear carried thereon and engaging a rack gear for rotating the cutter head for tab forming and tape cutting.

Other objects, advantages, features and results will more fully appear in the course of the following description.

SUMMARY OF THE INVENTION

An apparatus for taping a product with a length of tape from a tape source, including means for receiving a product on the adhesive side of the tape for rolling the product into the tape while applying a pulling force on the tape source and moving the product away from the source. The apparatus further includes means for cutting the product wrapped tape from the remainder of the tape leaving a tape end, and engaging and folding the tape end on itself to form a tab while moving the tape end toward the tape source.

A tape dispenser with a support for a roll of tape and a pivoted lever unit which moves between a rest position and a taping position. The lever unit has a cutter head and a tape support means, typically a roller. The adhesive tape moves along a path from the tape source over the tape support means to the cutter head with the adhesive side of the tape exposed away from the components. Tape engaging means are incorporated in the cutter which pivots between a tab forming position and a cutting position. The lever mechanism is configured so that during a taping operation, the lever unit moves toward the taping position and the cutter head pivots into the cutting position. Cutting of the tape releases the pulling force on the tape and the lever unit moves in the opposite direction with the cutter head engaging the newly cut and free end of the tape, pivoting toward the tab forming position as the lever moves to the rest position, folding the free end of the tape on itself to form the tab, and engaging the tab to hold the tape in place on the dispenser.

The presently preferred embodiment has a single lever unit pivoting in a housing with the cutter head carried thereon and rotated by a rack and pinion device, with the roll of tape also carried in the lever unit.

BRIEF DESCRIPTION OF THE DRAWINGS

FIG. 9 is a side view similar to that of FIG. 1 showing an alternative and presently preferred embodiment of the invention, partly in section;

FIG. 10 is a sectional view taken along the line 10—10 of FIG. 9;

DESCRIPTION OF THE PREFERRED EMBODIMENTS

Figure 1:
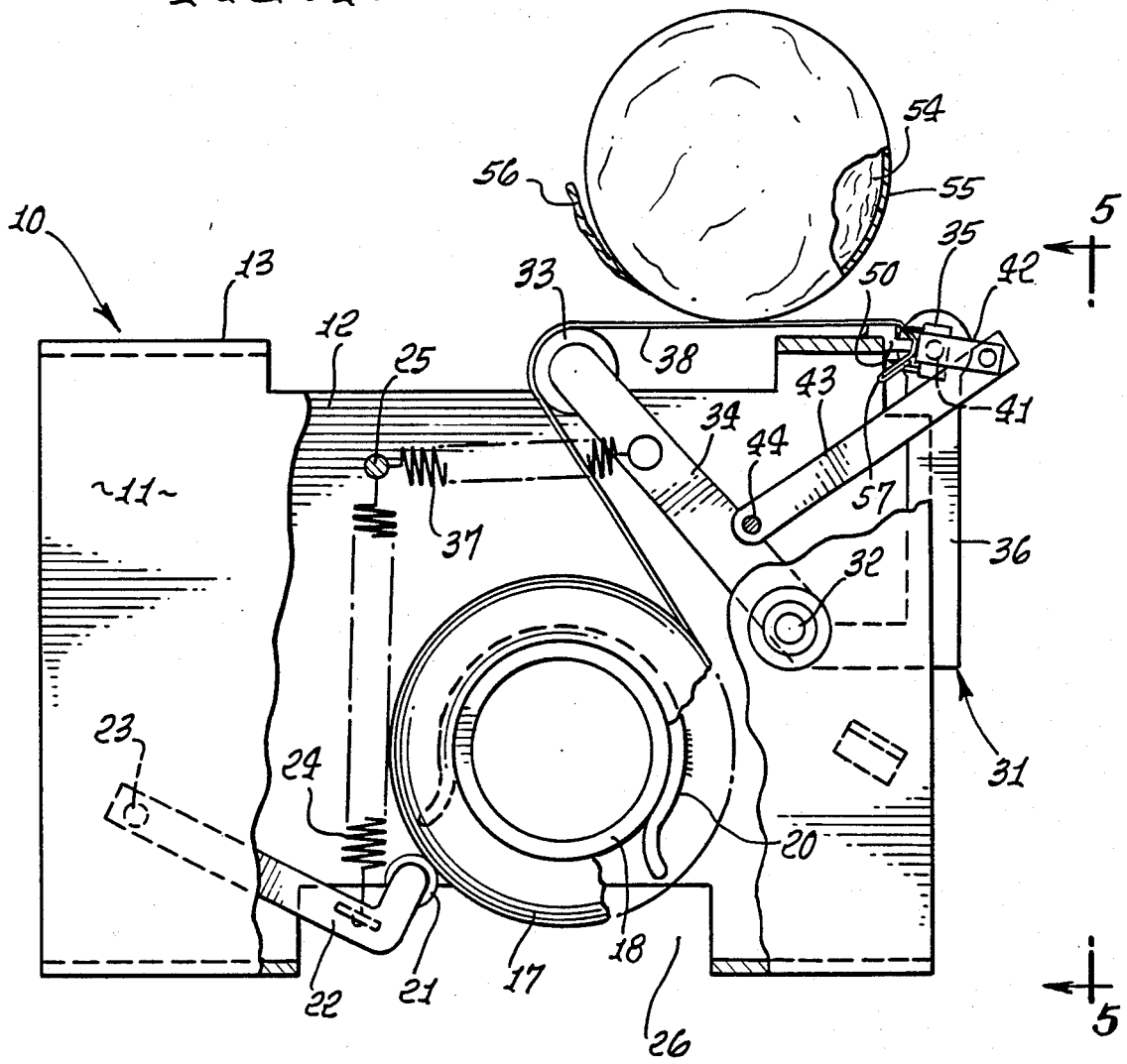
FIG. 1 is a side view of a tape dispenser incorporating one embodiment of the invention and showing the device in the rest or start position.

The embodiment of the invention as illustrated in FIGS. 1-8 includes a frame 10 having sides 11, 12, a top 13 and a bottom 14. Typically the frame may be made of a length of a box beam, but other frame constructions may be utilized as desired. Means are provided in the frame for supporting a roll of tape 17 mounted on a spool 18. In the embodiment illustrated, two arcuate shoulders 19, 20 are fixed to the inner walls of the sides 11, 12 for receiving the spool 18, with the shoulders spaced from each other permitting the roll of tape 17 to project between the shoulders. The spool 18 is urged upward against the shoulders 19, 20 by a roller 21 carried on a lever 22 which pivots in the frame on a pin 23. A spring 24 is connected between the lever 22 and another pin 25 carried in the frame. An opening 26 is provided in the bottom 14 of the frame for removal of an empty tape spool and insertion of a fresh tape spool.

A lever unit 31 with fixed arms 34 and 36 is pivotally mounted in the frame on a shaft 32. A roller 33 is carried on one arm 34 of the lever unit, and a cutter head 35 is carried on the other arm 36 of the lever unit. The arm 34 typically comprises two spaced arms with the roller 33 mounted therebetween. Similarly the arm 36 typically comprises two spaced arms with the cutter 35 mounted therebetween. A spring 37 is connected between the arm 34 and the pin 25 for urging the lever unit in the counterclockwise direction as viewed in FIGS. 1-4. The tape 38 from the spool 17 passes over the roller 33, with the roller serving as a support for the tape. While a roller is preferred for ease of operation, a smooth fixed surface may be utilized as the tape support if desired.

Figure 7:
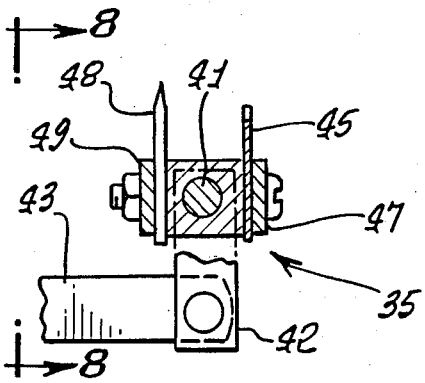
FIG. 7 is an enlarged side view of the cutter head of the tape dispenser of FIG. 1.
Figure 8:
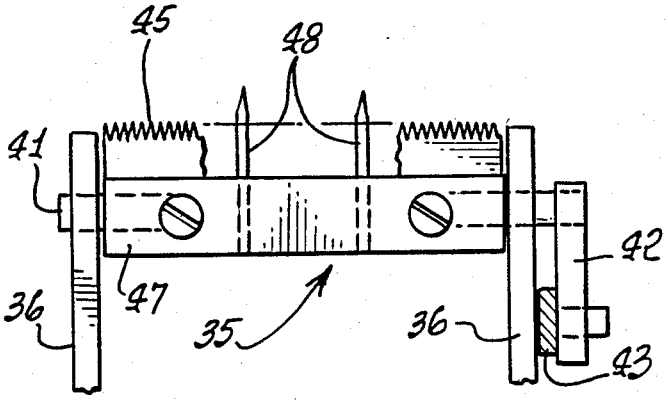
FIG. 8 is an end view of the cutter head of FIG. 7.
Figure 6:
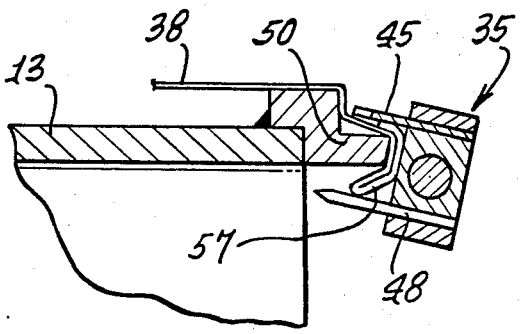
FIG. 6 is an enlarged partial sectional view of the device of FIG. 1, taken along the line 6—6 of FIG. 5.

The cutter head 35 is shown in greater detail in FIGS. 7 and 8. The cutter head is pivotally mounted on a shaft 41 in the arm 36 of the lever unit. A crank arm 42 is attached to the shaft 41 at one end, with the other end coupled to a link 43 which is pivotally mounted to the frame by a pin 44. In the preferred embodiment illustrated, a cutter plate 45 with a serrated or tooth-like edge is carried on the cutter head by another plate 47 attached by screws. Spaced pins 48 are also carried on the cutter head, being clamped by another plate 49 also attached by screws. The serrated cutter plate 45 functions in the conventional manner to sever the tape. The pins 48 function as tape engaging means for engaging the tape when the tape is pulled down across the cutter head. That is, the pins 48 function to engage the newly created free end of the tape when the tape is severed at the cutter head. The top 13 of the frame provides a work surface and typically has a horizontally projecting rib 50 which engages the cutter head 35 between the cutter plate 45 and the pins 48 in a manner to prevent the tooth-like edge being exposed in the rest or inoperative position (FIG. 6).

The operation of the tape dispenser of the invention will be described in conjunction with the taping of a head of lettuce 54 which has been placed in a plastic bag 55 having a twist closure 56. Of course, the method and apparatus of the invention are equally suitable for taping other products.

The apparatus is shown in the start or rest position in FIG. 1, with the tape 38 resting on the top 13 of the frame. The spool of tape is positioned in the frame so that the adhesive side of the tape is up away from the various components of the device. A tab 57 is formed at the free end of the tape by folding the free end back on itself in a manner to be described.

The operator places the bagged product down onto the adhesive side of the tape as shown in FIG. 1. The operator then rotates the product counterclockwise as seen in FIG. 1 and pulls the product to the right thereby wrapping the tape around the product. The partially wrapped product is shown in FIG. 2.

Figure 2:
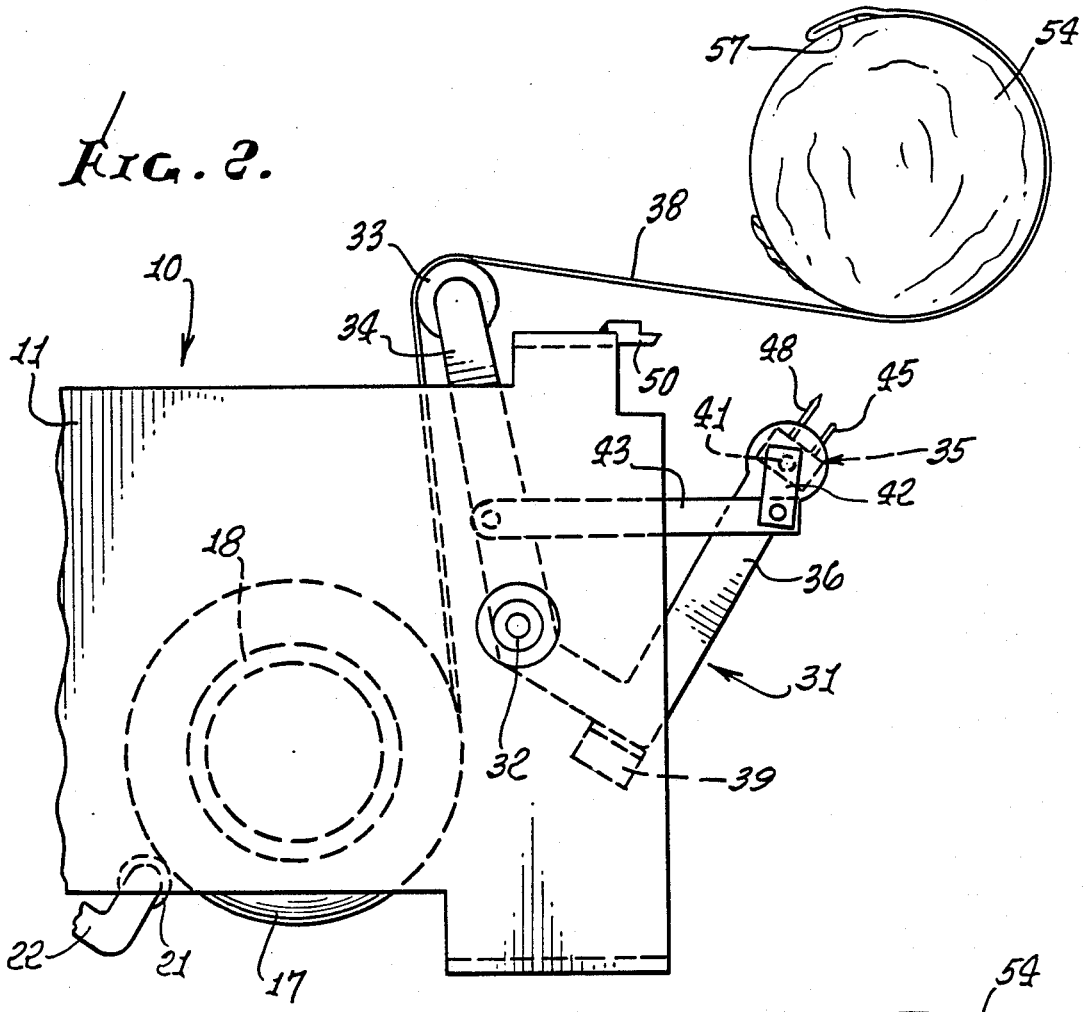
FIG. 2 is a partial view similar to that of FIG. 1 showing the product in the partially wrapped condition.

The pulling force applied by the operator in rolling the tape onto the product peels the tape from the roll 17 and also applies a force to the lever arm at the roller 33 which causes the lever unit to pivot clockwise to the position shown in FIG. 2 with the lever unit engaging the stop 39. As the lever unit 31 is rotated clockwise, the link 43 by being coupled to one end of the crank arm 42 causes the cutter head to rotate clockwise in the end of the arm 36. The cutter head rotates from the position shown in FIG. 1 to the position shown in FIG. 2.

Figure 3:
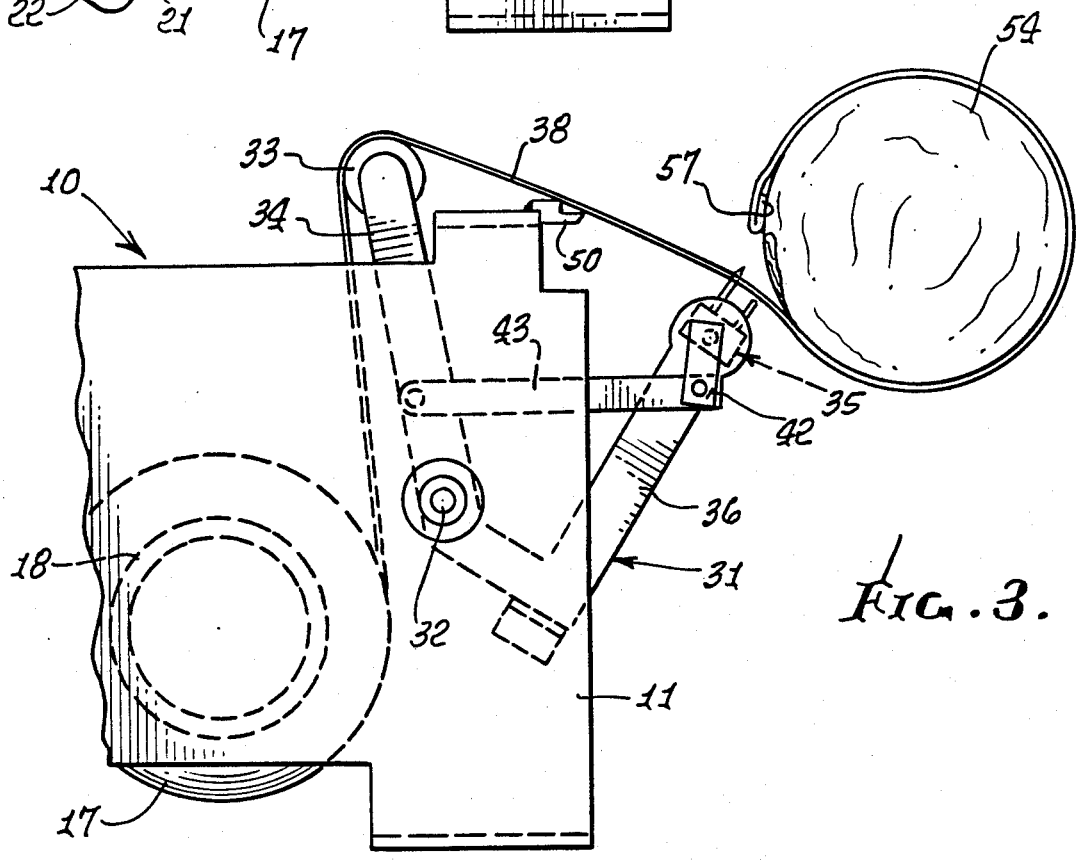
FIG. 3 is a partial view similar to that of FIGS. 1 and 2 showing the taped product in the ready to cut position.
Figure 4:
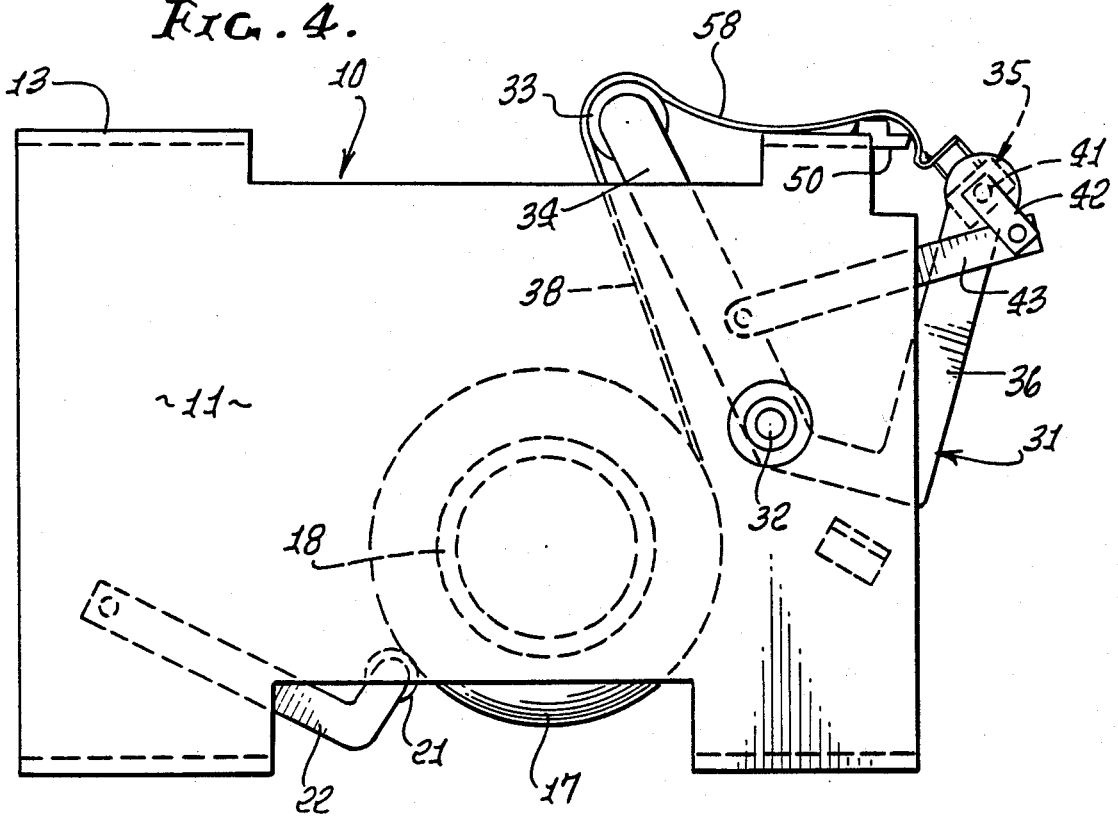
FIG. 4 is a view similar to that of FIGS. 1-3 showing the device in the tape folding condition.
Figure 5:
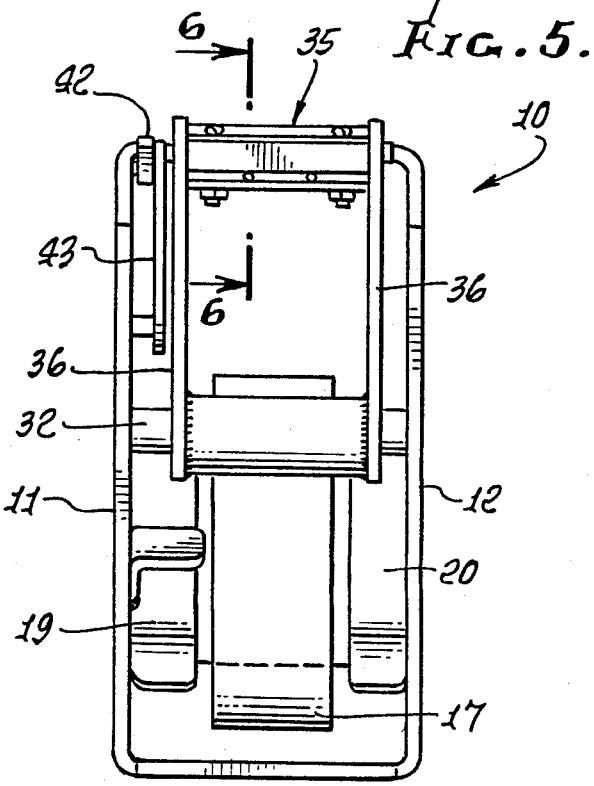
FIG. 5 is an end view of the device of FIG. 1, taken along the line 5—5 of FIG. 1.

When the tape is wrapped around the product to the degree desired, the operator pulls the tape down across the cutter head as shown in FIG. 3 and the tape on the product is severed from the remainder of the tape. The product is now taped, with the tab 57 free from adhesive contact with the product. As the tape is pulled down on the cutter head to sever the tape, the tape also engages the pins 48 which retain the newly created free end of the tape.

When the tape is severed, the pulling force which has extended the spring 37, is removed and the spring 37 rotates the lever unit 31 counterclockwise. As the lever unit rotates counterclockwise, the cutter head 35 is pivoted counterclockwise in the arm 36 by the link 43, producing a downward bow at 58 in the tape. See FIG. 4. While a spring is preferred to provide the restoring force, other means, such as a counterweight, can be used if desired.

The lever unit continues to rotate counterclockwise until the motion is stopped by engagement with a stop, typically engagement of the cutter head with the rib 50. By this time, the severed end of the bowed section 58 has been folded by the pins 48 and the cutter plate 45 to form the tab 57 (FIG. 6) and the device is now in the condition of FIG. 1 ready for taping another product.

While the taping operation has been described as a series of discrete steps, the method and apparatus are such that the operator may tape the product and have the dispenser reset with a formed tab for taping another product in a single operator motion. The product is picked up from a container and moved downward to engage the upwardly facing adhesive, rolled away from the operator while being pulled toward the operator to tape the product, pulled downward to sever the tape, and placed in another container.

Thus, it is seen that the desired taping is accomplished simply and easily and the desired free tab is formed without any separate operation by the operator.

In the alternative and presently preferred embodiment of the invention shown in FIGS. 9–13, a frame 110 is formed from mating half sections 112 and 114, which typically are aluminum castings, and which contain sets of mating flanges 113 and 115, respectively, at the upper front, lower front and lower rear inner edges thereof, and which are removably fastened together by machine screws 116.

Pivotally mounted within the frame 110 is a lever unit 118 which is also formed from mating plate-like half sections 120 and 122, typically aluminum castings, which include two sets of inter-engaging spacing projections 124 and 126, respectively, which are removably fastened together by machine screws 128.

The lever unit 118 contains opposed front arm portions 130 and opposed rear arm portions 132 which converge adjacent the lower ends thereof to receive outwardly extending pivot pins 134 which project into bushings 136 (FIG. 12) contained in hubs 138 formed on the inner surfaces of the half sections 112 and 114.

A spring 140 (FIG. 9) is connected between the front part of the frame 110 at a pin 142 and the front part of the level unit 118 at an opening 144, and functions to bias the lever unit in the counterclockwise direction as viewed in FIG. 9.

Means for releasably supporting a roll of adhesive tape 146 is provided within the frame, and in the illustrated embodiment comprises two opposed C-shaped clips 148 which are mounted in spaced apart relationship within the lever unit 118 by tabs 151 and screws 152. The adhesive tape 146 is preferably carried on a tube 154 of pressed paper which is of a diameter to provide a press fit into the clips 148.

A tape support roller 156 (FIGS. 9 and 11) is mounted between the upper ends of the front arm portions 130 of the lever unit 118 by pins 158 (FIG. 10).

A cutter head 135 (FIGS. 9 and 10) is pivotally mounted between the upper ends of the rear arm portions 132 of the lever unit 118 on a shaft 160 which is received in bushings 162, which cutter head can be of the same construction as the cutter head 35 of the embodiment of FIGS. 1–8, and including adjustably mounted pins 48 and an adjustable cutter plate 45.

For pivoting the cutter head between the tape cutting position and the tab forming position, a pinion gear 164 is mounted at one end of the shaft 160 (FIGS. 9 and 10), for operative engagement with an arcuate-shaped rack gear 166 (FIG. 13) which is supported in an arcuate slot 168 formed in a boss or enlargement 170 on the inner surface of the half section 114, and on a spaced-apart flange portion 172 (FIG. 9). The rack gear 166 is held in place by a machine screw 174.

Figure 11:
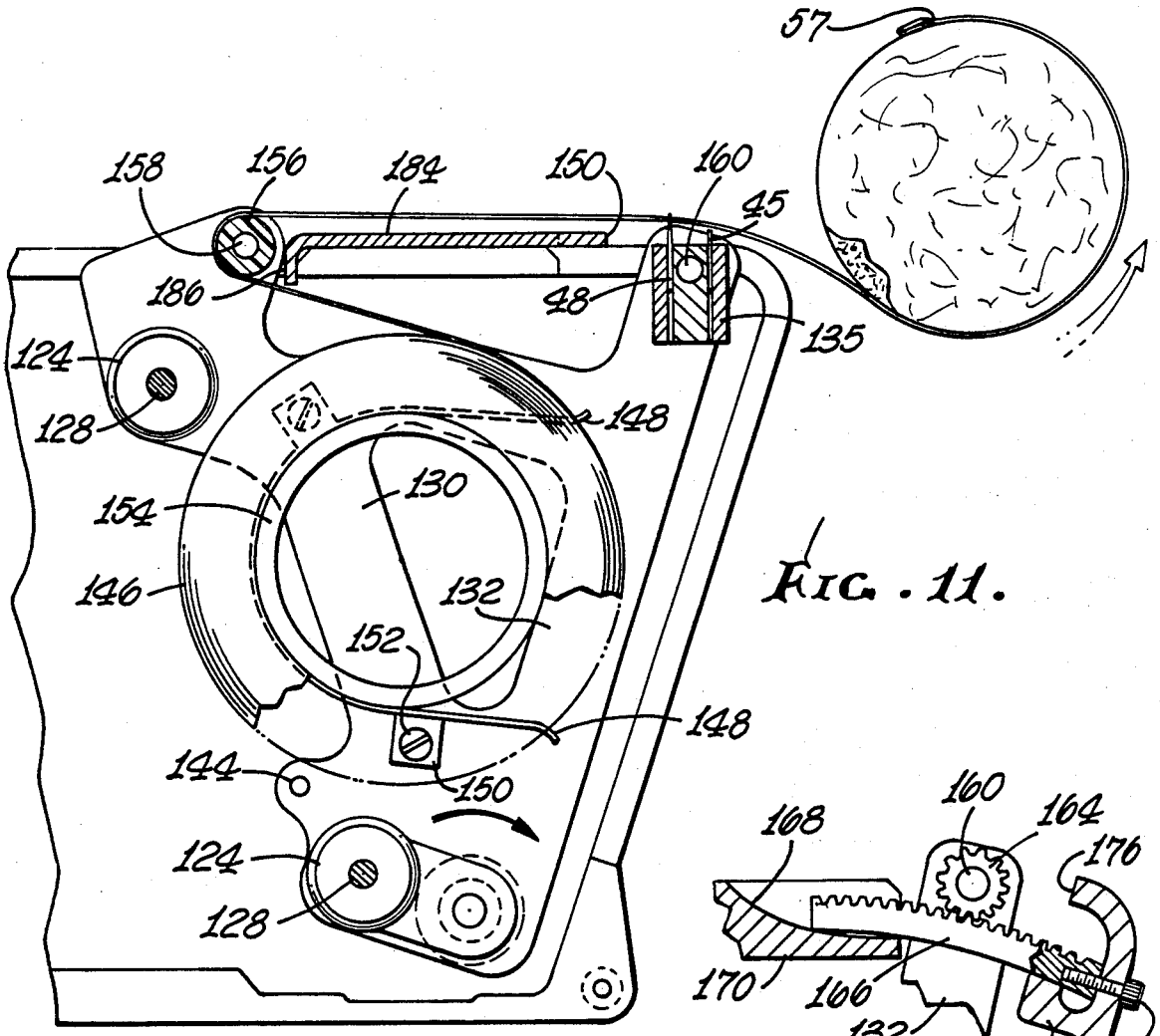
FIG. 11 is a partial sectional view taken along the line 11—11 of FIG. 10 and showing the taped product in the ready to cut position.
Figure 13:
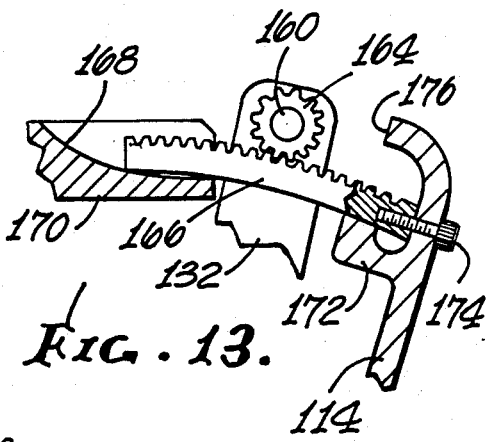
FIG. 13 is a partial sectional view taken along the line 13—13 of FIG. 10.
Figure 12:
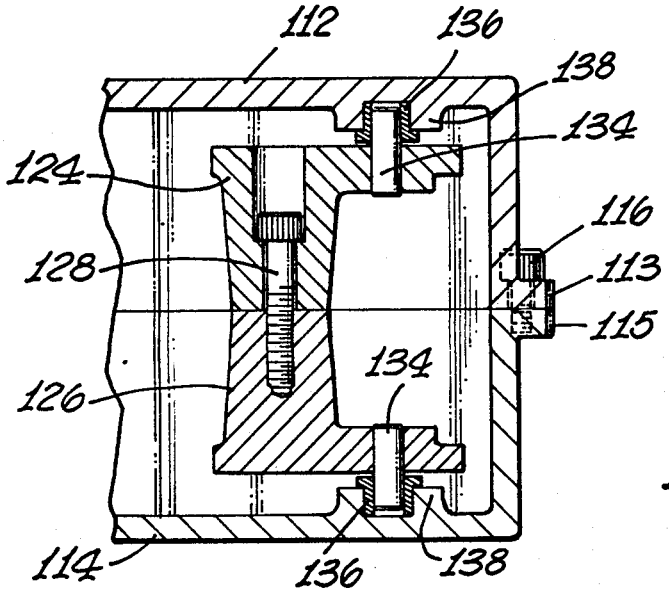
FIG. 12 is a partial sectional view taken along the line 12—12 of FIG. 9.

As shown in FIGS. 10 and 11, the frame halves 112 and 114 contain inwardly extending, abutting flange portions 178 and 180 at the upper ends thereof, the forward and rearward edges of said flange portions preferably being beveled.

Removably and adjustably fastened to the upper surfaces of these flange portions, as by machine screws 182, is a stainless steel cover plate 184 which has a depending flange 186 at the forward edge thereof and two spaced-apart notches 188 at the rearward edge 150. The notches 188 prevent the pins 48 from being broken by engagement with the rear edge 150 during the adjusting procedure, as described more fully hereinafter.

When the lever unit 118 is pivoted from the rest position (FIG. 9) to the tape cutting position (FIG. 11), an edge of the front arm portion 130 thereof adjacent to the roller 156 engages the depending flange 186 of the cover plate 184 to stop the movement of the lever unit.

The rear edge 150 of the cover plate 184 performs the same function as the rib 50 in the embodiment of FIGS. 1–8, in forming a tab on the free end of the cut tape (FIG. 6).

In addition to providing a stop flange for the lever unit during the movement from the rest position to the tape cutting position, the cover plate 184 also provides means for adjustably positioning the edge 150 relative to the cutter head 135 in the tab forming position. Thus, holes are initially drilled in the cover plate 184 to receive the screws 182, and after the lengths of the pins 48 and the position of the serrated edge of the cutter plate 45 are adjusted, and the proper position of the cover plate 184 is determined for forming a tab on the free end of the tape, aligned holes are drilled in the flanges 178 and 180 and then tapped to receive the screws 182.

The stainless steel cover plate 184 also limits the movement of the lever unit 118 from the tape-cutting position to the rest or tab-forming position. As previously described, the aforesaid movement is terminated when the serrated edge of the cutter plate 45 engages the upper surface of the cover plate 184.

The advantages of having a cover plate 184 made of stainless steel are that the serrated edge of the cutter plate 45 would "chew-up" a softer plate or the upper surfaces of the flanges 178 and 180 if the cover plate were omitted, and, in addition, the juices from the bagged heads of lettuce being taped would discolor the aluminum flanges 178 and 180 and thereby cause the plastic bags containing the heads of lettuce to also become discolored.

The embodiment shown in FIGS. 9–12 operates in the same manner as the embodiment shown in FIGS. 1–8, with the rolling engagement of the pinion gear and rack gear providing the pivoting of the cutter head.

The free end of the tape 146 is passed around the roller 156 with the adhesive side outward and with the tape resting on the upper surface of the cover plate 184. The apparatus 15 shown in the start or rest position in FIG. 9.

To utilize the apparatus, the operator places the bagged product (preferably lettuce) onto the adhesive side of the tape which is laying on the cover plate 184, and rotates the product counterclockwise and pulls it to the right, thereby wrapping the tape around the product. The force applied by the operator peels the tape from the roll and also pivots the lever unit clockwise to the position of FIG. 11, where the front arm portion 130 of the lever unit 118 engages the depending flange 186.

Movement of the pinion gear along the rack gear causes the cutter head to rotate clockwise, and when the tape is wrapped around the product to the desired degree, the operator pulls the tape down across the serrated edge of the cutter plate supported in the cutter head.

As the tape is pulled down on the cutter plate to sever the tape, the tape also engages the pins 48 which retain the newly cut, free end of the tape.

The pulling force which has extended the spring 140 is terminated by the aforesaid cutting movement, and the spring then pivots the lever unit counterclockwise toward the rest position shown in FIG. 9. As the pinion gear moves along the rack gear in the opposite direction, the cutter head 135 is also pivoted counterclockwise and the engagement of the serrated edge of the cutter plate 45 with the upper surface of the cover plate 184 stops the counterclockwise movement.

The free end of the tape has been folded by the pins 48, the cutter plate 45 and the edge 150, to form the tab 57, with the tab being retained in position between the upper surface of the cover plate 184 and the serrated edge of the cutter plate 45.

The apparatus is then in position for another taping operation.

Having described only the preferred forms and application of the invention, I do not wish to be limited to the specific details herein set forth but reserve to myself any modifications and/or variations that might appear to those skilled in the art and which fall within the scope of the following claims.

I claim:

1. In a tape dispenser, the combination of:

a frame;

first tape support means disposed within said frame for supporting a roll of adhesive tape;

a lever unit pivotally mounted on said frame for movement between a rest position and a tape cutting position;

a cutter head pivotally mounted on said lever unit for movement between a tab forming position and a tape cutting position;

second tape support means positioned between said first tape support means and said cutter head so that an adhesive tape moves from the first tape support means, over the second tape support means to the cutter head with the adhesive side of the tape exposed away from the second support means;

means responsive to the movement of tape over the second tape support means for moving the lever unit from the rest position to the tape cutting position;

return means in engagment with said lever unit yieldably urging said lever unit toward the rest position;

means responsive to the movement of the lever unit from the rest position to the tape cutting position for pivoting the cutter head from the tab forming position to the tape cutting position, including interengaging rack and pinion gears, with one of said gears mounted on said frame and with the other said gears carried on said lever unit; and tape engaging means on said cutter head including a cutting blade for severing the tape when the cutter head is in the tape cutting position to provide a tape end, said tape engaging means folding said tape end back upon itself on the adhesive side to form a tab following the providing of the tape end and during the subsequent movement of the lever unit from the tape cutting position to the rest position.

2. A tape dispenser as described in claim 1, wherein said first tape support means is carried in said lever unit.

3. A tape dispenser as described in claim 2, wherein said first tape support means includes spaced C-shaped clips for receiving and retaining a roll of adhesive tape in said lever unit.

4. A tape dispenser as described in claim 1, wherein said lever unit comprises two mating half sections joined in side by side relationship, with said first and second tape support means and said cutter head mounted between said half sections.

5. A tape dispenser as described in claim 1, further including stop means on said frame limiting the movement of the lever unit to the tape cutting position.

6. A tape dispenser as described in claim 1, wherein said tape engaging means further includes pin means for engagement with the tape accompanying severing of the tape to provide a tape end.

7. A tape dispenser as described in claim 6, wherein said pin means is formed and arranged to pierce and retain the tape end in position on the cutter head following the severing of the tape.

8. A tape dispenser as described in claim 1, further including means on the frame limiting the movement of the lever unit to the rest position and coacting with the tape engaging means to complete the formation of said tab.

9. A tape dispenser as described in claim 1, further including means on the frame coacting with the tape engaging means to releasably maintain said tab in engagement with the cutter head following formation of the tab and when the lever unit is in the rest position.

10. A tape dispenser as described in claim 1, wherein said tape engaging means further includes pin means in spaced apart relationship with said cutting blade for holding engagement with said tape following the severing of the tape and during the formation of said tab.

11. A tape dispenser as described in claim 10, further including flange-like means on the frame received between said cutting blade and said pin means when the lever unit is in the rest position.

12. A tape dispenser as described in claim 1, further including a plate member over which the tape passes from the second tape support means to the cutter head, and which includes a first edge portion facing the second tape support means and a second edge portion facing the cutter head.

13. A tape dispenser as described in claim 12, in which the position of the plate member is adjustable and the lever unit engages said first edge portion for stopping the pivotal movement of the lever unit to the tape cutting position.

14. A tape dispenser as described in claim 12, wherein the tape engaging means further includes at least two spaced apart pin members formed and arranged to pierce and retain the tape end on the cutter head following the severing of the tape, and in which said second edge portion of the plate member contains notches in alignment with the positions of the pin members to prevent engagement of said pin members with the plate member.

15. A tape dispenser as described in claim 12, wherein the cutting blade on the cutter head engages the plate member adjacent said second edge portion for stopping the pivotal movement of the lever unit to the rest position.

16. A tape dispenser as described in claim 1, wherein said frame comprises two mating half sections joined in side by side relationship and which include inwardly extending, abutting flange portions positioned between the second tape support means and the cutter head, and which further includes a plate member removably fastened on said flange portions to provide a smooth surface over which the tape passes from the second tape support means to the cutter head.

17. A tape dispenser as described in claim 16, in which the plate member includes a first edge portion facing the second tape support means and a second edge portion facing the cutter head, and the lever unit engages said first edge portion for stopping the pivotal movement of the lever unit to the tape cutting position.

18. A tape dispenser as described in claim 17, wherein the tape engaging means further includes at least two spaced apart pin members formed and arranged to pierce and retain the tape end on the cutter head following the severing of the tape, and in which said second edge portion of the plate member contains notches in alignment with the positions of the pin members to prevent engagement of said pin members with the plate member.

* * * * *